US009240134B2

(12) United States Patent
Yamada et al.

(10) Patent No.: US 9,240,134 B2
(45) Date of Patent: Jan. 19, 2016

(54) DEVICE FOR CONTROLLING ELECTRO-OPTIC DEVICE INCLUDING WRITE SECTION THAT EXECUTES FIRST AND SECOND WRITE OPERATIONS DURING WHICH DIFFERENT VOLTAGES ARE APPLIED TO PIXELS, METHOD FOR CONTROLLING ELECTRO-OPTIC DEVICE ELECTRO-OPTIC DEVICE, AND ELECTRONIC APPARATUS

(71) Applicant: Seiko Epson Corporation, Tokyo (JP)

(72) Inventors: Yusuke Yamada, Matsumoto (JP); Kota Muto, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 292 days.

(21) Appl. No.: 13/772,584

(22) Filed: Feb. 21, 2013

(65) Prior Publication Data

US 2013/0229445 A1 Sep. 5, 2013

(30) Foreign Application Priority Data

Mar. 1, 2012 (JP) ..... 2012-045581

(51) Int. Cl.
*G09G 5/10* (2006.01)
*G09G 3/20* (2006.01)
*G09G 3/34* (2006.01)

(52) U.S. Cl.
CPC ..... *G09G 3/2003* (2013.01); *G09G 3/344* (2013.01); *G09G 2300/0809* (2013.01); *G09G 2310/0254* (2013.01)

(58) Field of Classification Search
CPC ..... G09G 3/344; G09G 2310/02542; G09G 2310/068; G09G 5/10; G09G 3/30; G09G 3/34; G09G 3/32; G09G 3/36; G02F 1/15
See application file for complete search history.

(56) References Cited

U.S. PATENT DOCUMENTS

| | | | |
|---|---|---|---|
| 6,061,043 | A | 5/2000 | Bonnett et al. |
| 6,329,976 | B1 | 12/2001 | Johnson et al. |
| 6,784,891 | B2 | 8/2004 | Inuzuka et al. |
| 2002/0044122 | A1 | 4/2002 | Kuwata et al. |
| 2004/0095402 | A1 | 5/2004 | Nakano |
| 2004/0201564 | A1 | 10/2004 | Sugino et al. |
| 2004/0263495 | A1 | 12/2004 | Sugino et al. |
| 2005/0024310 | A1 | 2/2005 | Shiomi et al. |
| 2005/0156838 | A1 | 7/2005 | Miyagawa et al. |
| 2007/0057906 | A1 | 3/2007 | Johnson et al. |
| 2007/0146561 | A1* | 6/2007 | Zhou et al. ..... 349/2 |
| 2008/0211756 | A1 | 9/2008 | Shiomi et al. |
| 2008/0284700 | A1 | 11/2008 | Oke et al. |

(Continued)

FOREIGN PATENT DOCUMENTS

| | | | |
|---|---|---|---|
| CN | 101840666 | A | 9/2010 |
| JP | 2001-331144 | A | 11/2001 |

(Continued)

*Primary Examiner* — Pegeman Karimi
(74) *Attorney, Agent, or Firm* — ALG Intellectual Property, LLC

(57) ABSTRACT

When a write operation to change the pixel into one of the first gray level and the second gray level is stopped before completion of the write operation, and when a write section executes a write operation to change the pixel into another of the first gray level and the second gray level, the write section executes the write operation by voltage application to change the pixel into the other gray level the same number of times of voltage application as the number of times of voltage application in the write operation that has been stopped.

5 Claims, 8 Drawing Sheets

(56) References Cited

U.S. PATENT DOCUMENTS

| | | | | |
|---|---|---|---|---|
| 2008/0291223 | A1 | 11/2008 | Yamazaki et al. | |
| 2009/0040201 | A1 | 2/2009 | Kim et al. | |
| 2009/0058779 | A1 | 3/2009 | Yoshihara et al. | |
| 2009/0167754 | A1 | 7/2009 | Hatta | |
| 2009/0256798 | A1 | 10/2009 | Low et al. | |
| 2010/0220122 | A1 | 9/2010 | Zehner et al. | |
| 2010/0231571 | A1 | 9/2010 | Tanabe | |
| 2011/0001748 | A1* | 1/2011 | Rutman et al. | 345/214 |
| 2011/0279432 | A1 | 11/2011 | Yamada | |
| 2011/0285755 | A1 | 11/2011 | Umezaki | |
| 2012/0162545 | A1 | 6/2012 | Shiomi et al. | |
| 2012/0200554 | A1 | 8/2012 | Kim et al. | |
| 2012/0262498 | A1 | 10/2012 | Kanamori et al. | |
| 2012/0262505 | A1 | 10/2012 | Muto et al. | |
| 2012/0287175 | A1 | 11/2012 | Yamada | |
| 2015/0054816 | A1 | 2/2015 | Yamada | |

FOREIGN PATENT DOCUMENTS

| | | | |
|---|---|---|---|
| JP | 2002-311900 | A | 10/2002 |
| JP | 2002-366103 | A | 12/2002 |
| JP | 2003-207762 | A | 7/2003 |
| JP | 2004-85606 | A | 3/2004 |
| JP | 2004-302460 | A | 10/2004 |
| JP | 2004-348151 | A | 12/2004 |
| JP | 2005-181917 | A | 7/2005 |
| JP | 2008-20858 | A | 1/2008 |
| JP | 2009-251615 | A | 10/2009 |
| JP | 2011-237709 | A | 11/2011 |
| JP | 2012-220826 | A | 11/2012 |
| JP | 2012-225983 | A | 11/2012 |
| JP | 2012-237958 | A | 12/2012 |
| WO | WO-2007-116438 | A | 10/2007 |

* cited by examiner

DEVICE FOR CONTROLLING ELECTRO-OPTIC DEVICE INCLUDING WRITE SECTION THAT EXECUTES FIRST AND SECOND WRITE OPERATIONS DURING WHICH DIFFERENT VOLTAGES ARE APPLIED TO PIXELS, METHOD FOR CONTROLLING ELECTRO-OPTIC DEVICE ELECTRO-OPTIC DEVICE, AND ELECTRONIC APPARATUS

BACKGROUND

1. Technical Field

The present invention relates to devices for controlling an electro-optic device, methods for controlling an electro-optic device, electro-optic devices, and electronic apparatuses.

2. Related Art

As display devices that display an image, electrophoretic display devices that use micro capsules are known. Among such display devices, an active matrix type display device includes a plurality of row electrodes extending in a row direction, a plurality of column electrodes extending in a column direction, and drive circuits provided respectively at intersections of the plural row electrodes and the plural column electrodes for driving microcapsules. When a voltage is applied across the row electrode and the column electrode, a potential difference is generated between an electrode installed on the drive circuit and another electrode provided opposite the electrode with the microcapsules interposed between them. As the potential difference is generated between the opposing electrodes with the microcapsules interposed between them, white particles and black particles in the microcapsules move according to the electric field generated by the potential difference. As the optical reflection property changes due to the change in the distribution of white particles and black particles in each microcapsule changes, an image would be displayed.

In some of such electrophoretic display devices, there is a type in which image rewriting, when changing a display by the active matrix method, may be performed over a plurality of frames. However, if the image rewriting starts on the full screen when performing the image rewriting over a plurality of frames, new writing cannot be performed until the current writing is completed. Accordingly, when adding or deleting an image, the next writing would be started only after the current image writing is completed. Such an operation would take time, and therefore pose a problem in terms of operability.

In order to solve such a problem, a method of performing the writing through performing pipeline processing in units of a partial region has been proposed (see, for example, JP-A-2009-251615). According to the method described in JP-A-2009-251615, an image is written on the screen in two partial regions which do not overlap each other, at different timings. Accordingly, even if the writing of a partial region where writing has started first is not completed, the writing of the other partial region where writing is to be started later can be started. As a result, the display speed can be improved, compared with a case where the same method is not adopted.

In the method described in JP-A-2009-251615, however, if the partial regions overlap in part, the writing of the partial region where writing is to be started later has to wait until the writing of the partial region where writing has started first ends. For this reason, it takes time until the display is completed.

In this respect, it may be conceivable to start the next writing before completing the current writing to shorten the time for completing the display. However, for example, if the writing operation to change the gray level of pixels to white starts during the write operation to change the gray level of pixels to black, a deviation occurs between the number of times of voltage application to change the pixels to black and the number of times of voltage application to change the pixels to white, whereby the pixels are quickly deteriorated.

SUMMARY

In accordance with some aspects of the invention, deterioration of pixels can be suppressed even when an operation to change the gray level of pixels is newly started while the gray level of pixels is being changed.

In accordance with an embodiment of the invention, a control device is provided for controlling an electro-optic device that includes a display section including a plurality of pixels. The electro-optic device performs a write operation to change the pixels from a first gray level to a second gray level and a write operation to change the pixels from the second gray level to the first gray level through applying voltage to the pixels multiple times, wherein the polarity of the voltage for changing the pixel to the first gray level and the polarity of the voltage for changing the pixel to the second gray level are different from each other. In one aspect, the control device includes a write section that, when stopping a write operation to change the pixel into one of the first gray level and the second gray level before completion of the write operation, and executing a write operation to change the pixel into the other gray level, executes the write operation to change the pixel into the other gray level the same number of times of voltage application as the number of times of voltage application in the write operation that has been stopped.

According to this configuration, if a writing operation to change the gray level of a pixel into one of the first gray level and the second gray level is stopped before its completion, and the gray level of the pixel is changed to the other gray level, a writing operation to change the pixel into the other gray level is executed through voltage application the same number of times of voltage application as the number of times of voltage application in the write operation to the one of the gray levels that is stopped. When the pixel is changed into the first gray level or into the second gray level, the voltages to be applied are mutually different in the polarity, but are the same in the number of times of voltage application, such that fewer deviation is caused between the number of times of voltage application to change the pixel into the first gray level and the number of times of voltage application to change the pixel into the second gray level, and therefore deterioration of the pixel can be suppressed.

In accordance with an aspect of the embodiment, the control device may include a counter section that counts the number of frames for each pixel that passed since the write operation to change the pixel to the first gray level or the second gray level was started. When the write operation to change the pixel into the one gray level before completion of the write operation, and the write operation to change the pixel into the other gray level is executed, the write section may be configured to stop the write operation to change the pixel into the one gray level after the number of frames counted by the counter section reaches a predetermined number of frames.

According to this configuration, the write operation to change the pixel into the other gray level is not executed until the predetermined number of frames is reached. Therefore, when a write operation to change the pixel into the other gray level is started during the write operation to change the pixel to the one gray level, changes in the gray level of the pixel can be recognized during the write operation, such that, in a motion image, it is possible to recognize tracks of the movement of the image.

Another embodiment of the invention pertains to a control method for controlling an electro-optic device includes controlling the electro-optic device that includes a display section including a plurality of pixels. The control method includes performing a write operation to change the pixel from a first gray level to a second gray level and a write operation to change the pixel from the second gray level to the first gray level through applying voltage to the pixels multiple times, the polarity of the voltage for changing the pixel to the first gray level and the polarity of the voltage for changing the pixel to the second gray level being different from each other. In one aspect, the control method includes, when a write operation to change the pixel into one of the first gray level and the second gray level is stopped before completion of the write operation, and a write operation to change the pixel into the other gray level is executed, executing the write operation to change the pixel into the other gray level the same number of times of voltage application as the number of times of voltage application in the write operation that has been stopped.

According to this configuration, if, before completion of a writing operation to change the gray level of the pixel into one of the first gray level and the second gray level, the gray level of the pixel is changed to the other gray level, a writing operation to change the pixel into the other gray level is executed through voltage application the same number of times of voltage application as the number of times of voltage application in the write operation to change the pixel into the one of the gray levels that is stopped. When the pixel is changed into the first gray level or into the second gray level, the voltages to be applied are mutually different in the polarity, but are the same in the number of times of voltage application, such that fewer deviation is caused between the number of times of voltage application to change the pixel into the first gray level and the number of times of voltage application to change the pixel into the second gray level, and therefore deterioration of the pixel can be suppressed.

Still another embodiment of the invention pertains to an electro-optic device equipped with a display section including a plurality of pixels. The electro-optic device performs a write operation to change the pixels from a first gray level to a second gray level and a write operation to change the pixels from the second gray level to the first gray level through applying voltage to the pixels multiple times, the polarity of the voltage for changing the pixels to the first gray level and the polarity of the voltage for changing the pixels to the second gray level being different from each other. In one aspect, the electro-optic device includes a write section that, when a write operation to change the pixel into one of the first gray level and the second gray level is stopped before completion of the write operation, and a write operation to change the pixel into the other gray level is executed, executes the write operation to change the pixel into the other gray level the same number of times of voltage application as the number of times of voltage application in the write operation that has been stopped.

According to this configuration, if, before completion of a writing operation to change the gray level of a pixel into one of the first gray level and the second gray level, the gray level of the pixel is changed to the other gray level, a write operation to change the pixel into the other gray level is executed through voltage application the same number of times of voltage application as the number of times of voltage application in the write operation to change the pixel into the one of the gray levels that has been stopped. When the pixel is changed into the first gray level or into the second gray level, the voltages to be applied are mutually different in the polarity, but are the same in the number of times of voltage application, such that fewer deviation is caused between the number of times of voltage application to change the pixel into the first gray level and the number of times of voltage application to change the pixel into the second gray level, and therefore deterioration of the pixel can be suppressed.

The invention can be realized not only as an electro-optic device, but also as an electronic apparatus having the electro-optic device.

DESCRIPTION OF EXPLANATORY EMBODIMENTS

First Embodiment

Configuration of First Embodiment

Figure 1:
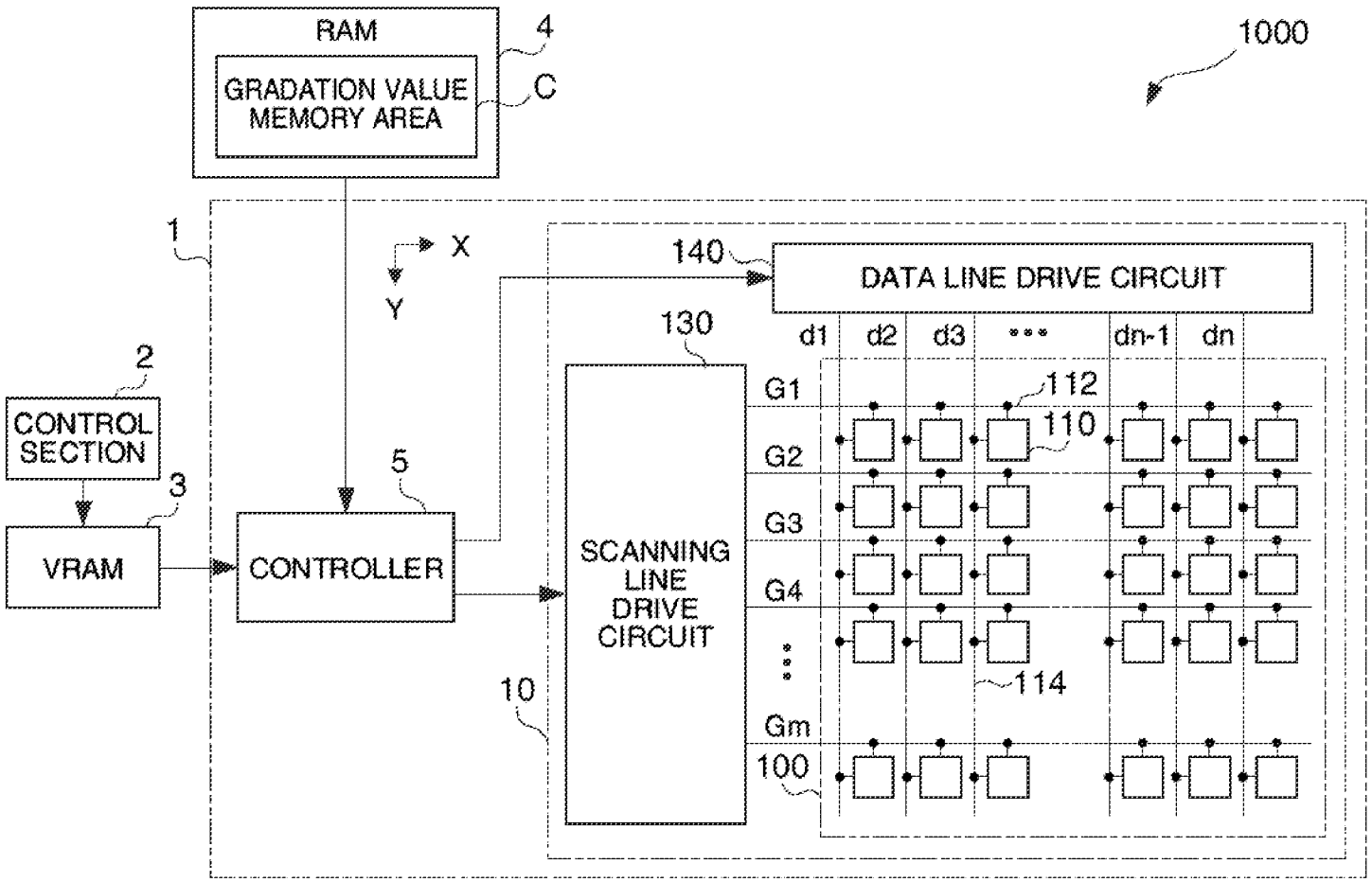
FIG. 1 is a diagram showing a hardware configuration of a display device 1000 and an electro-optic device 1 in accordance with a first embodiment.

FIG. 1 is a block diagram showing a hardware configuration of a display device 1000 in accordance with an embodiment of the invention. The display device 1000 is a device that displays an image, and is equipped with an electrophoretic type electro-optic device 1, a control section 2, a VRAM (Video Random Access Memory) 3, and a RAM 4 that is an example of a memory section. Moreover, the electro-optic device 1 has a display section 10 and a controller 5.

The control section 2 is a microcomputer that is equipped with a CPU (Central Processing Unit), a ROM (Read Only Memory), a RAM, etc., and controls each of the sections of the display device 1000. The control section 2 accesses the VRAM 3, and writes, to the VRAM 3, image data indicative of an image to be displayed in the display area 100. The controller 5 supplies various signals for displaying the image in the display area 100 in the display section 10 to a scanning line drive circuit 130 and a data line drive circuit 140 of the display section 10. The controller 5 corresponds to a control device of the electro-optic device 1. Note that a portion of the control section 2 and the controller 5 combined may be defined as a control device of the electro-optic device 1. Alternatively, the control section 2, the controller 5, the VRAM 3 and the RAM 4 as a whole may be defined as the control device of the electro-optic device 1.

The VRAM 3 is a memory that stores image data written by the control section 2. The VRAM 3 has a memory area (buffer) for each of pixels 110 arranged by a matrix of m rows by n columns to be described later. The image data contains pixel data indicative of a gray level of each of the pixels 110, and pixel data indicative of a gray level of one pixel 110 is stored in one memory area corresponding to the pixel 110 in the VRAM 3. Pixel data written in the VRAM 3 is read by the controller 5. The RAM 4 stores various data used to display an image in the display area 100. A gray level value memory area C is provided in the RAM 4. Details of the memory areas that are provided in the RAM 4 will be described later.

In the display area 100, a plurality of scanning lines 112 are provided along the row (X) direction in FIG. 1, and a plurality of data lines 114 are provided along the column (Y) direction in a manner to be electrically insulated from the scanning lines 112. Further, the pixel 110 is provided at a location corresponding to the intersection between each of the scanning lines 112 and each of the data lines 114. Assuming for the sake of convenience that the number of rows of the scanning lines 112 is "m" and the number of columns of the data lines 114 is "n", the pixels 110 are arrayed in a matrix (m rows×n columns) to form the display area 100.

Figure 2:
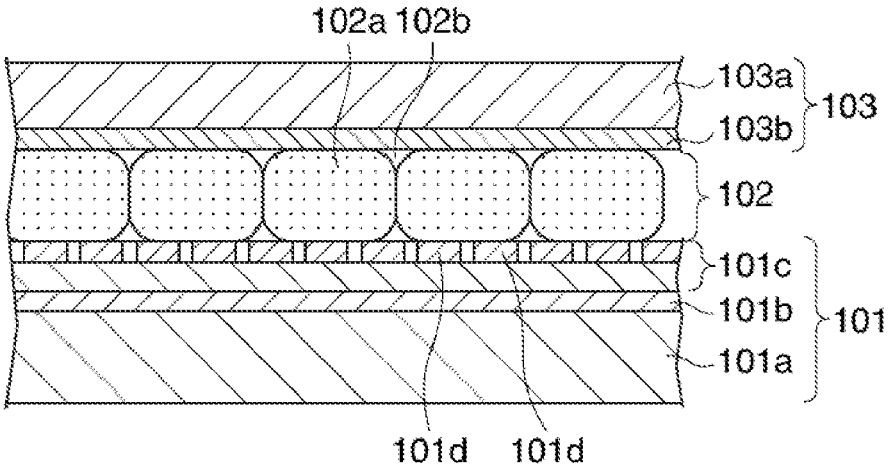
FIG. 2 is a cross-sectional view of a display area 100.

FIG. 2 is a view showing the cross section of the display area 100. As shown in FIG. 2, the display area 100 is formed generally from a first substrate 101, an electrophoretic layer 102, and a second substrate 103. The first substrate 101 is a substrate in which a circuit layer is formed on an insulating and flexible substrate 101*a*. In the present embodiment, the substrate 101*a* is formed from polycarbonate. Note that a resin material which is light and flexible, and has elasticity and insulation property may also be used for the substrate 101*a* without any particular limitation to polycarbonate. In addition, the substrate 101*a* may be formed from glass which does not have flexibility. An adhesive layer 101*b* is provided on the surface of the substrate 101*a*, and a circuit layer 101*c* is laminated on the surface of the adhesive layer 101*b*. The circuit layer 101*c* has a plurality of scanning lines 112 arrayed in the row direction and a plurality of data lines 114 arrayed in the column direction. Also, the circuit layer 101*c* has a pixel electrode 101*d* corresponding to each of the intersections between the scanning lines 112 and the data lines 114.

The electrophoretic layer 102 is formed from a binder 102*b* and a plurality of microcapsules 102*a* fixed by the binder 102*b*, and is formed on the pixel electrodes 101*d*. In addition, an adhesive layer formed from an adhesive may be provided between the microcapsules 102*a* and the pixel electrodes 101*d*.

The binder 102*b* may be made of any material that has good affinity with the microcapsules 102*a*, excellent adhesion to the electrodes, and dielectric property, without any particular limitation. Each of the microcapsules 102*a* contains a dispersion medium and electrophoretic particles. The microcapsules 121 may preferably be made of a material having flexibility, such as, composites of gum arabic and gelatin, urethane compounds, and the like.

As the dispersion medium, it is possible to use any one of materials including water; alcohol solvents (such as, methanol, ethanol, isopropanol, butanol, octanol, and methyl cellosolve); esters (such as, ethyl acetate and butyl acetate); ketones (such as, acetone, methyl ethyl ketone, and methyl isobutyl ketone); aliphatic hydrocarbons (such as, pentane, hexane, and octane); alicyclic hydrocarbons (such as, cyclohexane and methylcyclohexane); aromatic hydrocarbons (such as, benzene, toluene, long-chain alkyl group-containing benzenes (such as, xylenes, hexylbenzene, heptylbenzene, octylbenzene, nonylbenzene, decylbenzene, undecylbenzene, dodecylbenzene, tridecylbenzene, and tetradecylbenzene)); halogenated hydrocarbons (such as, methylene chloride, chloroform, carbon tetrachloride, and 1,2-dichloroethane); and carboxylates. Also, the dispersion medium may be made of any one of other various oils. As the dispersion medium, one or any of the materials described above in combination may be used. Further in another example, the dispersion medium may be further mixed with a surfactant.

The electrophoretic particles are particles (polymer or colloid) having a property in which the particles move in the dispersion medium by electric fields. In the present embodiment, white electrophoretic particles and black electrophoretic particles are contained in each of the microcapsules 102*a*. The black electrophoretic particles are particles formed of black pigments, such as, aniline black, carbon black and the like, and are positively charged in the present embodiment. The white electrophoretic particles are particles formed of white pigment, such as, titanium dioxide, aluminum oxide and the like, and are negatively charged in the present embodiment.

The second substrate 103 includes a film 103*a* and a transparent common electrode layer 103*b* (second electrode) formed on the bottom surface of the film 103*a*. The film 103*a* serves to seal and protect the electrophoretic layer 102, and is a polyethylene terephthalate film, for example. The film 103*a* is transparent and has an insulation property. The common electrode layer 103*b* is formed from a transparent conductive film, such as, an indium tin oxide film (ITO film).

Figure 3:
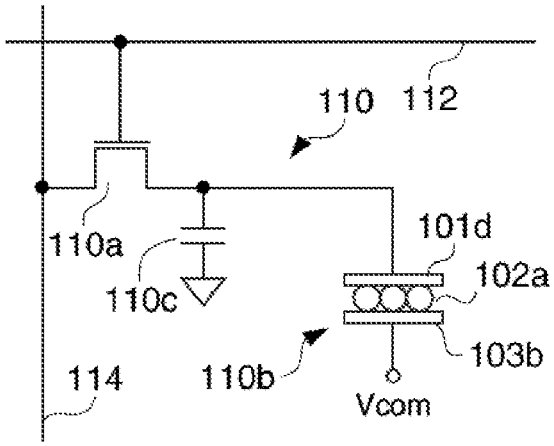
FIG. 3 is a diagram showing an equivalent circuit of a pixel 110.

FIG. 3 is a view showing an equivalent circuit of the pixel 110. In the present embodiment, in order to distinguish the scanning lines 112, the scanning lines 112 shown in FIG. 1 may be called scanning lines on the first, the second, the third, . . . , the $(m-1)^{-th}$, and the $m^{-th}$ rows in this order from the top. Similarly, in order to distinguish the data lines 114, the data lines 114 shown in FIG. 1 may be called data lines on the first, the second, the third, . . . , the $(n-1)^{-th}$, and the $n^{-th}$ columns in this order from the left.

FIG. 3 shows an equivalent circuit of the pixel 110 corresponding to the intersection between the scanning line 112 on the $i^{-th}$ row and the data line 114 on the $j^{-th}$ column. Since the pixels 110 corresponding to the intersections between other data lines 114 and other scanning lines 112 also have the same configuration shown in the drawing, an equivalent circuit of the pixel 110 corresponding to the intersection between the data line 114 on the $i^{-th}$ row and the scanning line 112 on the $j^{-th}$ column will be representatively described, and explanation regarding equivalent circuits of other pixels 110 will be omitted.

As shown in FIG. 3, each of the pixels 110 has an n channel type thin film transistor (hereinafter, abbreviated as a "TFT")

110*a*, a display element 110*b*, and an auxiliary capacitor 110*c*. In the pixel 110, the TFT 110*a* has a gate electrode connected to the scanning line 112 on the $i^{-th}$ row, a source electrode connected to the data line 114 on the $j^{-th}$ column, and a drain electrode connected to a pixel electrode 101*d*, which is an end of the display element 110*b*, and an end of the auxiliary capacitor 110*c*. The auxiliary capacitor 110*c* has a configuration in which a dielectric layer is interposed between a pair of electrodes formed in the circuit layer 101*c*. The other electrode of the auxiliary capacitor 110*c* has a voltage common to all pixels. The pixel electrode 101*d* faces the common electrode layer 103*b*, and the electrophoretic layer 102 is interposed between the pixel electrode 101*d* and the common electrode layer 103*b*. Therefore, when seen in the equivalent circuit, the display element 110*b* is a capacitor in which the electrophoretic layer 102 is interposed between the pixel electrode 101*d* and the common electrode layer 103*b*. In addition, the display element 110*b* retains (stores) a voltage between these electrodes and performs display according to the direction of an electric field caused by the retained voltage. Moreover, in the present embodiment, a common voltage Vcom is applied to the other end of the auxiliary capacitor 110*c* of each pixel 110 and the common electrode layer 103*b* by an external circuit (not shown).

Referring back to FIG. 1, the scanning line driving circuit 130 is connected to each of the scanning lines 112 of the display area 100. Under the control of the controller 5, the scanning line driving circuit 130 sequentially selects the scanning lines 112 at the first, the second, . . . , and the $m^{-th}$ rows in this order, and supplies a high-level (High) signal to the selected scanning line 112 and supplies a low-level (Low) signal to the other scanning lines 112 which are not selected. The data line driving circuit 140 is connected to each of the data lines 114 in the display area, and supplies a data signal to the data line 114 on each of the columns according to the display content of the pixels 110 for one row which are connected to the selected scanning line 112.

During a period starting from the selection of the scanning line 112 in the $1^{st}$ row by the scanning line drive circuit 130 until the completion of the selection of the scanning line in the $m^{-th}$ row (hereafter referred to as a "frame period" or, simply a "frame"), each of the scanning lines 112 is selected once, and a data signal is supplied to each of the pixels 14 once in each frame.

When the scanning line 112 changes to the high level, the TFT 110*a* whose gate is connected to the scanning line 112 is set to an ON state, whereby the pixel electrode 101*d* is connected to the data line 114. If a data signal is supplied to the data line 114 when the scanning line 112 is at a high level and, the data signal is applied to the pixel electrode 101*d* through the TFT 110*a* which is in the ON state. When the scanning line 112 changes to the low level, the TFT 110*a* is set to an OFF state. However, the voltage applied to the pixel electrode 101*d* by the data signal is accumulated in the auxiliary capacitor 110*c*, and electrophoretic particles move according to the potential difference (voltage) between the electric potential of the pixel electrode 101*d* and the electric potential of the common electrode layer 103*b*.

For example, when the voltage on the pixel electrode 101*d* is +15V (second voltage) with respect to the voltage Vcom on the common electrode layer 103*b*, white electrophoretic particles that are negatively charged move toward the pixel electrode 101*d* and black electrophoretic particles that are positively charged move toward the common electrode layer 103*b*. As a result, the pixel 110 is displayed in black. On the other hand, when the voltage on the pixel electrode 101*d* is −15V (first voltage) with respect to the voltage Vcom on the common electrode layer 103*b*, black electrophoretic particles that are positively charged move toward the pixel electrode 101*d* and white electrophoretic particles that are negatively charged move toward the common electrode layer 103*b*. As a result, the pixel 110 is displayed in white. Note that the voltage on the pixel electrode 101*d* is not limited to the above-described voltage, and may be a voltage other than +15V or −15V as long as it is a positive or negative voltage with respect to the voltage Vcom of the common electrode layer 103*b*.

In the present embodiment, when changing the display state of each pixel 110 from white (low gray level) as the first gray level to black (high gray level) as the second gray level or from black to white, the display state is changed by a write operation in which data signals are supplied to the pixel 110 over a plurality of frames, instead of changing the display state by supplying a data signal to the pixel 110 in only one frame. This is because, when changing the display state from white to black, black electrophoretic particles do not move to the display side completely even if the potential difference is given to the electrophoretic particles in only one frame, and therefore the display state does not become a full black display state. This is the same for white electrophoretic particles when changing the display state from black to white. Therefore, for example, data signals for displaying the black on the pixel 110 are supplied to the pixel 110 over a plurality of frames when changing the display state of the pixel 110 from white to black, and data signals for displaying the white on the pixel 110 are supplied to the pixel 110 over a plurality of frame when changing the display state of the pixel 110 from black to white. Note that, in the present embodiment, the "write operation" refers to a data signal supply sequence of supplying data signals to pixels for changing the display state of the pixels to a display state of a desired gray level, or a sequence of applying voltages between the common electrode layer 103*b* and the pixel electrode 101*d*, which is performed based on the data signal supply sequence.

Moreover, in the present embodiment, the pixel electrode 101*d* of a certain pixel 110 in one frame may be set as a positive electrode with a higher electric potential than the common electrode layer 103*b*, and the pixel electrode 101*d* of another pixel 110 in the same frame may be set as a negative electrode with a lower electric potential than the common electrode layer 103*b*. In other words, driving capable of selecting both electrodes of positive and negative electrodes with respect to the common electrode layer 103*b* in one frame (hereinafter, referred to as bipolar driving) is performed. More specifically, in one frame, the pixel electrode 101*d* of the pixel 110 whose gray level is changed to the high gray level side (second gray level side) is set as a positive electrode, and the pixel electrode 101*d* of the pixel 110 whose gray level is changed to the low gray level side (first gray level side) is set as a negative electrode. Note that, when black electrophoretic particles are negatively charged and white electrophoretic particles are positively charged, the pixel electrode 101*d* of the pixel 110 whose gray level is changed to the high gray level side (second gray level side) may be set as a negative electrode, and the pixel electrode 101*d* of the pixel 110 whose gray level is changed to the low gray level side (first gray level side) may be set as a positive electrode.

Figure 4A:
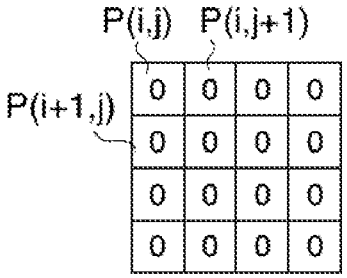
FIGS. 4A, 4B and 4C are illustrations for explaining memory areas.
Figure 4B:
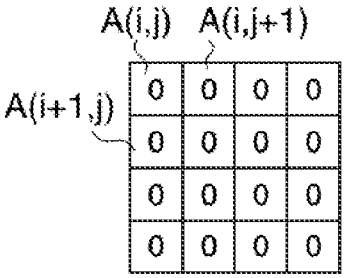
Figure 4C:
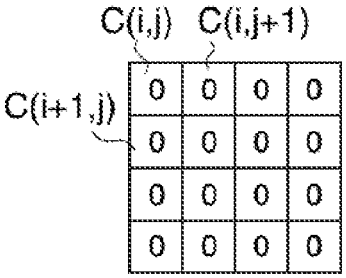

Next, the memory areas provided in the RAM 4 will be described. FIGS. 4A, 4B and 4C show portion of the pixels 110 in the display area 100, and memory areas respectively corresponding to the pixels 110. The memory areas correspond to the pixels 110 in m rows×n columns, respectively. FIG. 4A is an illustration showing the arrangement of the pixels 110. A pixel P(i, j) expresses one pixel 110 located on the $i^{-th}$ row and the $j^{-th}$ column. The subscript i indicates the row number of the pixel 110 arrayed in a matrix, and the subscript j indicates the column number.

FIG. 4B is an illustration showing buffers, each of which corresponds to each of the pixels shown in FIG. 4A, in the VRAM 3. For example, a buffer A(i, j) is a memory area corresponding to the pixel P(i, j). Pixel data indicative of the gray level of the pixel P(i, j) is stored in the buffer A(i, j). Note that, when a pixel is changed to black, pixel data with a value "0" is written, and when a pixel is changed to white, pixel data with a value "5" is written.

FIG. 4C is an illustration showing memory areas, each of which corresponds to each of the pixels shown in FIG. 4A, in the gray level value memory area C. For example, a gray level value memory area C(i, j) is a memory area corresponding to the pixel P(i, j). A value indicative of the gray level of the pixel P(i, j) that has changed by voltage application is stored in the gray level value memory area C(i, j).

Figure 5:
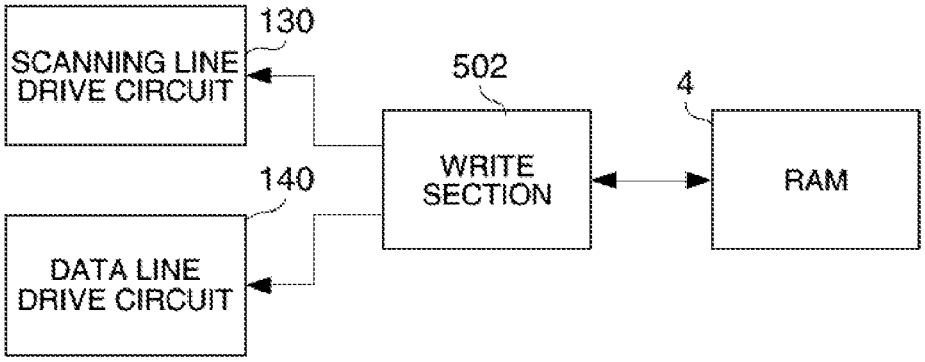
FIG. 5 is a block diagram of a configuration of functions that are realized by a controller 5.

Next, the configuration of the controller 5 will be described. FIG. 5 is a block diagram showing functions realized in the controller 5. In the controller 5, a write section 502 is realized. Note that the blocks may be realized by hardware, or may be realized by a program to be executed by a CPU provided in the controller 5.

The write section 502 is a block that performs writing operations to change the gray level of pixels to white or to black. The write section 502 controls the scanning line drive circuit 130 and the data line drive circuit 140 and applies the voltage for changing the pixel from white to black or the voltage for changing the pixel from black to white to the pixel over a plurality of frames, thereby changing the gray level of the pixel to white or to black. When a write operation to change the pixel into one of the gray levels to white or black is stopped before completion of the write operation, and a write operation to change the pixel into the other gray level is executed, the write section 502 executes the write operation to change the pixel into the other gray level the same number of times of voltage application as the number of times of voltage application in the write operation that has been stopped. Moreover, when the write section 502 accesses the gray level value memory area C, and executes write operation to change the gray level of the pixel, the write section 502 writes a value indicative of the gray level of the pixel changed by voltage application to the gray level value memory area C.

In the present embodiment, the number of times of voltage application (the number of frames) when the display state of the pixel is changed from white to black and the number of times of voltage application (the number of frames) when the display state of the pixel is changed from black to white are assumed to be the same.

Also in the present embodiment, it is assumed that the smaller the pixel data, the higher the density, and the value 0 is defined as black, and the value 5 is defined as a white. In the present embodiment, when the voltage of −15V with respect to the voltage Vcom on the common electrode layer 103*b* is applied to the pixel electrode 101*d* five times from the state of the pixel where the pixel data is 0 (the pixel being in the black state), the gray level of the pixel gradually changes and the pixel assumes the white state. On the other hand, when the voltage of +15V with respect to the voltage Vcom on the common electrode layer 103*b* is applied to the pixel electrode 101*d* five times from the state of the pixel where the pixel data is 5 (the pixel being in the white state), the gray level of the pixel gradually changes and the pixel assumes the black state.

The "completion" of the writing operation means that the writing operation has been performed until the display state of the pixel finally changes to a rewriting target gray level. In the present embodiment, the completion of the writing operation means that the state of the pixel in white changes to the black state after writing operation with the voltage of +15V has been performed five times, and the state of the pixel in black changes to the white state after writing operation with the voltage of −15V has been performed five times. Moreover, to "stop" the writing operation means to stop the writing operation to change the display state of the pixel to a rewriting target gray level before the display state of the pixel finally changes to the target gray level. In the present embodiment, to stop the writing operation means to stop the writing operation for the pixel in the white state after the writing operation with the voltage of +15V is performed four times or less before it assumes to be the black state, or to stop the writing operation for the pixel in the black state after the writing operation with the voltage of −15V is performed four times or less before it assumes to be the white state.

Operation Example of First Embodiment

Figure 6:
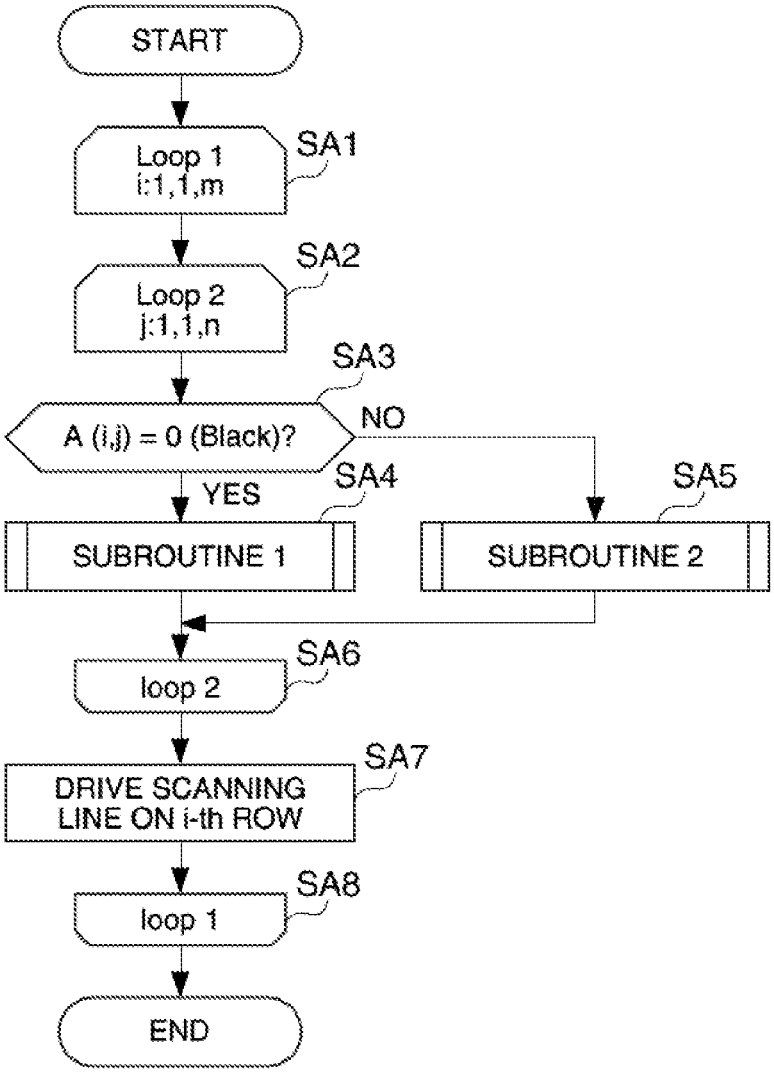
FIG. 6 is a flow chart showing process flow performed by the controller 5.
Figure 7:
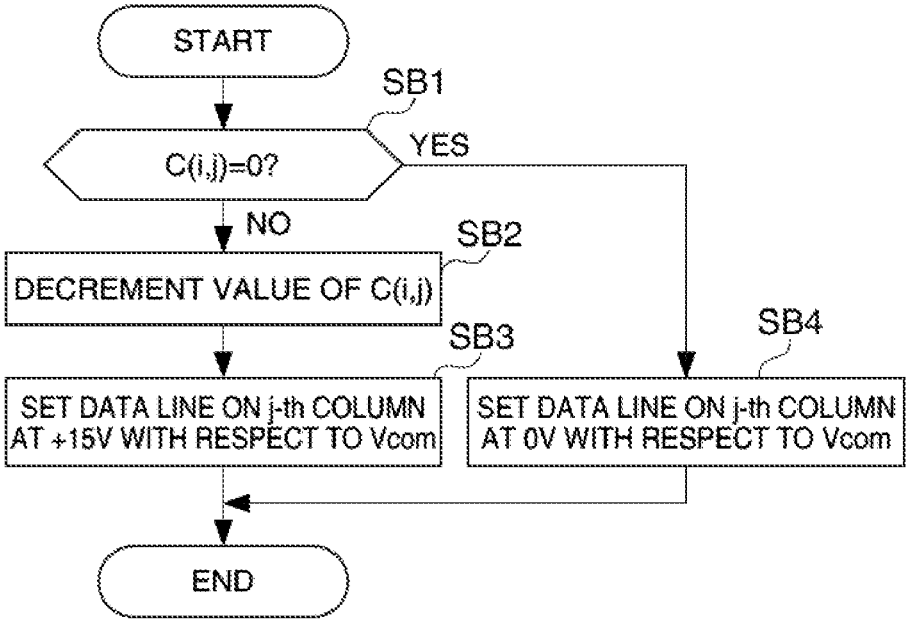
FIG. 7 is a flow chart showing process flow performed by the controller 5.
Figure 8:
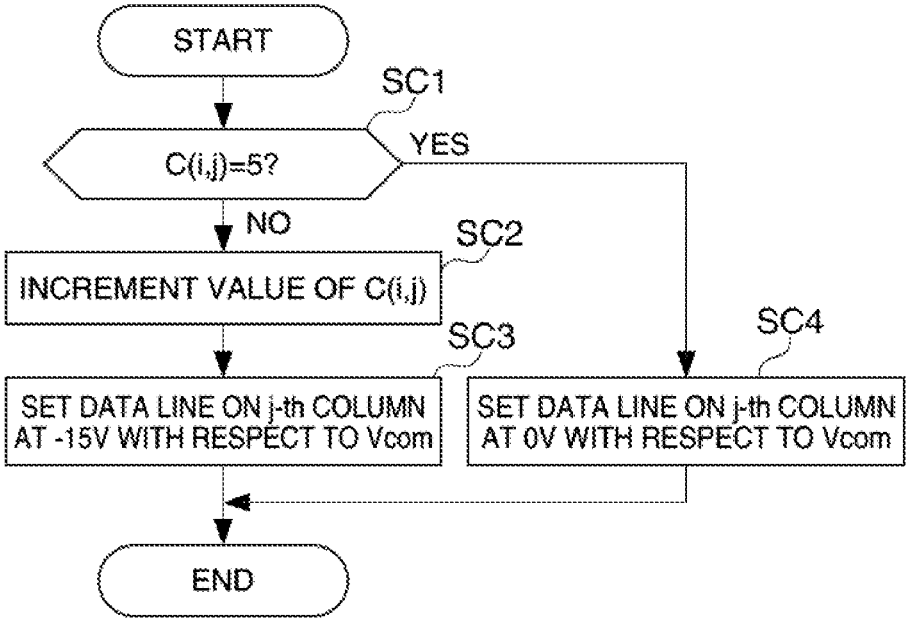
FIG. 8 is a flow chart showing process flow performed by the controller 5.
Figure 9:
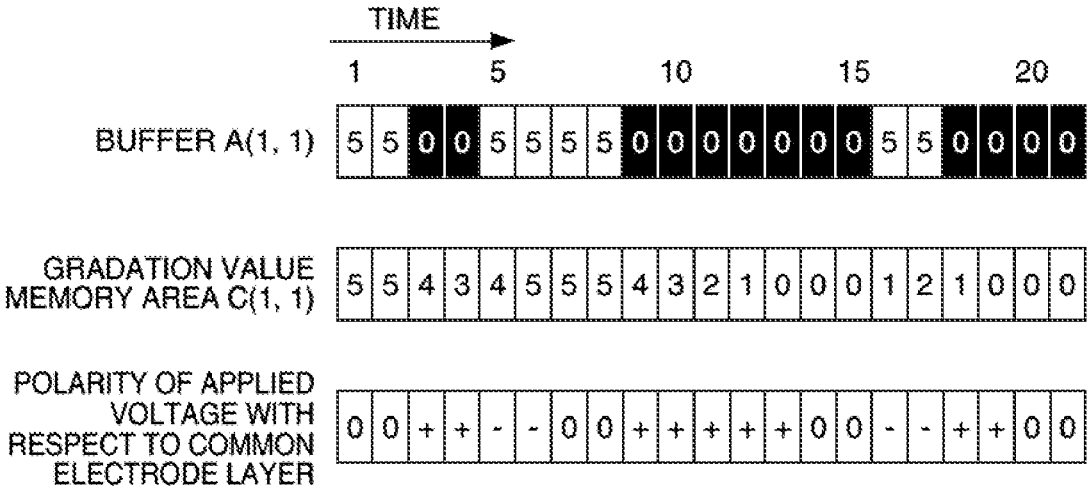
FIG. 9 is an illustration for explaining operations of the first embodiment.
Figure 10:
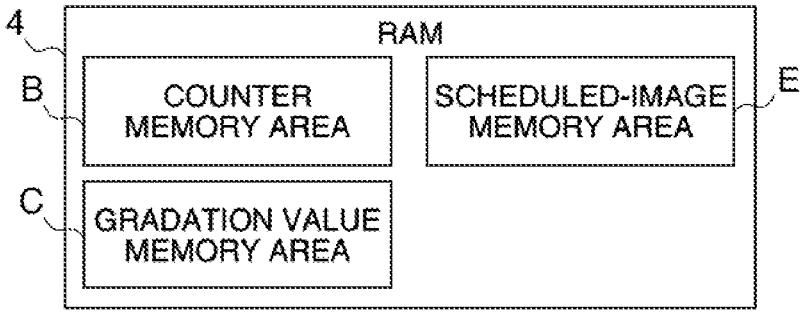
FIG. 10 is an illustration showing a configuration of a RAM 4 in accordance with a second embodiment.

Next, an operation of the present embodiment will be described. FIGS. 6 to 8 are flow charts showing the flow of processing performed by the controller 5. In addition, FIG. 9 is an illustration showing the content of each memory area changing with time, and shows the content of a buffer A(1, 1), and a gray level value memory area C(1, 1) corresponding to one pixel P(1, 1). Note that the content of each gray level value memory area is a value after a frame period ends. Further, FIG. 9 also shows the polarity of a voltage, which is applied to the pixel electrode 101*d* in one frame period, with respect to the common electrode layer 103*b*.

First, in the first frame shown in FIG. 9, the value of pixel data of the buffer A(1, 1) is 5, the value at the gray level value memory area C(1, 1) is 5. Here, until the third frame starts, the voltage applied to the pixel electrode 101*d* is the same as the voltage Vcom, and the value of each memory area does not change.

Then, when the content of the VRAM 3 is rewritten before the start of the third frame, and the controller 5 drives the scanning line drive circuit 130 and the data line drive circuit 140 during the frame period. Specifically, first, the controller 5 initializes variables i and j to set them to 1 (steps SA1 and SA2) in the processing shown in FIG. 6. Then, the controller 5 determines whether or not the value of the buffer A(i, j) is zero. When the value of the buffer A(i, j) is zero (black) (YES in step SA3), the controller 5 performs processing in step SA4 shown in FIG. 7.

First, the controller 5 judges if the value of the gray level value memory area C(i,j) is 0. When the value in the gray level value memory area C(i,j) is not 0 (NO in step SB 1), the controller 5 decrements the value of the gray level value memory area C(i,j) (step SB2). Also, the controller 5 sets the data line 114 of the $j^{-th}$ column to +15V (step SB3) with respect to the voltage Vcom, and moves the process flow to step SA6. When the value in the gray level value memory area C(i,j) is 0 (YES in step SB 1), the controller sets the data line 114 of the $j^{-th}$ column to 0V (step SB4) with respect to the voltage Vcom, and moves the process flow to step SA6.

On the other hand, when the value in the buffer A(i,j) is five (white) (NO in step SA3), the controller 5 executes the processing in FIG. 8 in step SA5. First, the controller 5 judges whether the value of the gray level value memory area C(i,j) is five. When the value of the gray level value memory area C(i,j) is not five (NO in step SC1), the controller 5 increments the value of the gray level value memory area C(i,j) (step SC2). The controller 5 sets the data line 114 of the $j^{-th}$ column to −15V with respect to the voltage Vcom (step SC3), and shifts the processing flow to step SA6. Moreover, when the value of the gray level value memory area C(i,j) is five (YES in step SC1), the controller 5 sets the data line 114 of the $j^{-th}$ column to 0V with respect to the voltage Vcom (step SC4), and shifts the processing flow to step SA6.

Referring back to FIG. 6, the controller 5 judges in step SA6 whether the value of the variable j is n. When the value of the variable j is not n, the controller 5 increments the variable j, and moves the processing flow to step SA3. Moreover, when the value of the variable j is n, the controller 5 drives the scanning line of $i^{-th}$ row (step SA7). Next, the controller 5 judges in step SA 8 whether the value of the variable i is m. When the value of the variable i is not m, the controller 5 increments the variable i, and moves the processing flow to step SA2. When the value of the variable i is m, the controller 5 ends the processing in FIG. 6.

In FIG. 9, at the time of beginning of the third frame, the value of the buffer A(1,1) is 0 (YES in step SA3), and the value of the gray level value memory area C(1,1) is 5 (NO in step SB1), the controller 5 decrements the value of the gray level value memory area C(1,1) to 4 (step SB2), and sets the data line 114 of the $1^{st}$ column to +15V with respect to the voltage Vcom (step SB3). Thereafter when the scanning line 112 of the $1^{st}$ row is driven (step SA7), the voltage of +15V with respect to the voltage Vcom is applied to the pixel electrode 101*d* of the pixel at the $1^{st}$ row and the $1^{st}$ column, such that black electrophoretic particles move to the side of the common electrode layer 103*b*.

In the fourth frame, it is judged YES in step SA3, and the value of the gray level value memory area C(1,1) is decremented to 3 and, thereafter, the voltage of +15V with respect to the voltage Vcom is applied to the pixel electrode 101*d* of the pixel at the $1^{st}$ row and the $1^{st}$ column, such that black electrophoretic particles move to the side of the common electrode layer 103*b*.

Thereafter, when the content of the VRAM 3 is rewritten before the $5^{th}$ frame starts and the value of the pixel data of the buffer A(1,1) is changed to 5, the controller 5 judges NO in step SA3 in the frame period. Next, because the content of the gray level value memory area C(1,1) is 3 (NO in step SC1), the controller 5 increments the value of the gray level value memory area C(1,1) to 4 (step SC2), and sets the data line 11 on the $1^{st}$ column to −15V with respect to the voltage Vcom (step SC3). Thereafter, when the scanning line 112 on the $1^{st}$ row is driven (step SA7), the voltage of −15V with respect to the voltage Vcom is applied to the pixel electrode 101*d* of the pixel at the $1^{st}$ row and the $1^{st}$ column, such that white electrophoretic particles to the side of the common electrode layer 103*b*.

In the sixth frame, it is judged NO in step SA3, and the value of the gray level value memory area C(1,1) is incremented to 5 and thereafter, the voltage of −15V with respect to the voltage Vcom is applied to the pixel electrode 101*d* of the pixel at the 1st row and the 1st column, such that white electrophoretic particles move to the side of the common electrode layer 103*b*.

In the seventh frame, after judging NO in step SA3, the controller 5 judges YES in SC1, as the value of the gray level value memory area C(1,1) is 5, and sets the data line on the $1^{st}$ column at 0V with respect to the voltage Vcom (step SC4).

Then, when the scanning line 112 on the $1^{st}$ row is driven (step SA7), the potential difference between the voltage on the pixel electrode 101*d* of the pixel at the $1^{st}$ row and $1^{st}$ column and the voltage Vcom is adjusted to 0V, such that white and black electrophoretic particles would not move.

In this manner, when the gray level of the pixel, while being changed from white to black, is changed to white, voltage for changing the gray level to white is applied the same number of times as the number of times the voltage has been applied for changing the gray level to black, such that deviation would not be generated between the number of times of voltage application for changing the pixel to black and the number of times of voltage application for changing the pixel to white.

Then, when the content of the VRAM 3 is rewritten, before the ninth frame starts, and the content of the buffer A(1, 1) becomes 0, the controller 5 performs the same processing as the processing performed for the third frame. Thereafter, if the content of the buffer A(1, 1) is not changed until the $13^{th}$ frame, the controller 5 performs the processing in step SA4 (the processing of FIG. 7) during the frame period. Accordingly, until the $13^{th}$ frame, the voltage of +15V with respect to the voltage Vcom is applied to the pixel electrode 101*d* of the pixel at the $1^{st}$ row and the $1^{st}$ column, such that black electrophoretic particles move to the side of the common electrode layer 103*b*. Note that, in the $14^{th}$ frame and the $15^{th}$ frame, because the content of the buffer A(1,1) is 0 and the content of the gray level value memory area C(1,1) is 0, the potential difference between the voltage on the pixel electrode 1 of the pixel at the $1^{st}$ row and the $1^{st}$ column is adjusted to zero, such that white and black electrophoretic particles would not move at the pixel at the $1^{st}$ row and the $1^{st}$ column.

Then, when the content of the VRAM 3 is rewritten before the $16^{th}$ frame starts, and the value of the pixel data of the buffer A(1,1) is changed to 5, the controller 5 judges NO in step SA3 when a frame period starts. Next, because the content of the gray level value memory area C(1, 1) is 0 (NO in step SC1), the controller 5 increments the value of the gray level value memory area C(1,1) to 1 (step SC2), and sets the data line 114 on the $1^{st}$ column to −15V with respect to the voltage Vcom (step SC3). Then, when the scanning line 112 on the $1^{st}$ row is driven (step SA7), the voltage of −15V with respect to the voltage Vcom is applied to the pixel electrode 101*d* of the pixel at the $1^{st}$ row and the $1^{st}$ column, such that white electrophoretic particles move to the side of the common electrode layer 103*b*.

In the $17^{th}$ frame, it is judged NO in step SA3, and the value of the gray level value memory area C(1,1) is incremented to 2 and, thereafter, the voltage of −15V with respect to the voltage Vcom is applied to the pixel electrode 101*d* of the pixel at the $1^{st}$ row and the $1^{st}$ column, such that white electrophoretic particles move to the side of the common electrode layer 103*b*.

Then, when the content of the VRAM 3 is rewritten before the $18^{th}$ frame starts and the content of the buffer A (1, 1) becomes 0, the controller 5 performs the same processing as the processing performed for the $3^{rd}$ frame. Thereafter, if the content of the buffer A(1, 1) is not changed, the controller 5 performs, in the $19^{th}$ frame, the processing in step SA4 (the processing of FIG. 7) in the frame period. As a result, the voltage of +15V with respect to the voltage Vcom is applied to the pixel electrode 101*d* of the pixel at the $1^{st}$ row and the $1^{st}$ column until the $19^{th}$ frame, such that black electrophoretic particles moves to the side of the common electrode layer 103*b*. Note that, in the $20^{th}$ frame and the $21^{st}$ frame, the content of the buffer A(1, 1) is 0, and the content of the gray level value memory area C(1, 1) is 0, and therefore the potential difference between the voltage on the pixel electrode 101*d* of the pixel at the $1^{st}$ row and the $1^{st}$ column and the voltage Vcom is adjusted to 0V, such that white and black electrophoretic particles would not move in the pixel at the $1^{st}$ row and the $1^{st}$ column.

In this manner, when the gray level of the pixel, while being changed from black to white, is changed to black, voltage for changing the gray level to black is applied the same number of times as the number of times the voltage has been applied for changing the gray level to white, such that deviation would not be generated between the number of times of voltage application for changing the pixel to white and the number of times of voltage application for changing the pixel to black.

Second Embodiment

Next, a second embodiment of the invention will be described. The second embodiment of the invention is different from the first embodiment in that the second embodiment is equipped with a counter memory area B and a scheduled-image memory area E. Also, the function realized by the controller 5 and the processing flow performed by the controller 5 are different from those of the first embodiment. Description of compositions of the second embodiment that are the same as those of the first embodiment will be omitted, and the differences will be described.

Figure 11A:
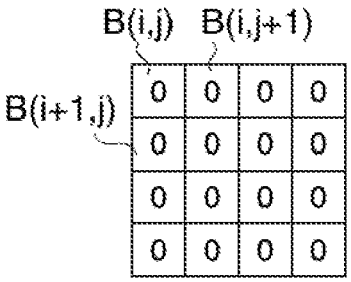
FIGS. 11A and 11B are an illustration for explaining a configuration of a counter memory region B and a scheduled-image memory region E.
Figure 11B:
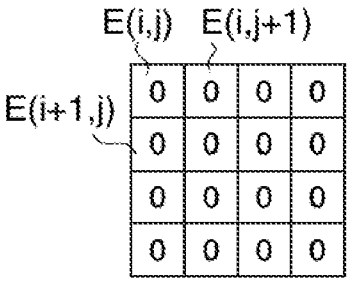

FIG. 11B is an illustration showing memory areas in a scheduled-image memory area E, which correspond to the pixels shown in FIG. 4A, respectively. For example, a scheduled-image memory area E(i, j) is a storage area corresponding to the pixel P(i, j). In the scheduled-image memory area E(i, j), pixel data of each of the pixels of an image scheduled to be displayed in the display area 100 is stored.

FIG. 11A is an illustration showing storage areas, in the counter memory area B, corresponding respectively to the pixels shown in FIG. 4A. For example, a counter memory area B(i, j) is a memory area corresponding to the pixel P(i, j). The counter memory area B(i, j) stores a value indicative of the number of frames until the scheduled-image memory area E(i, j) becomes rewritable.

Figure 12:
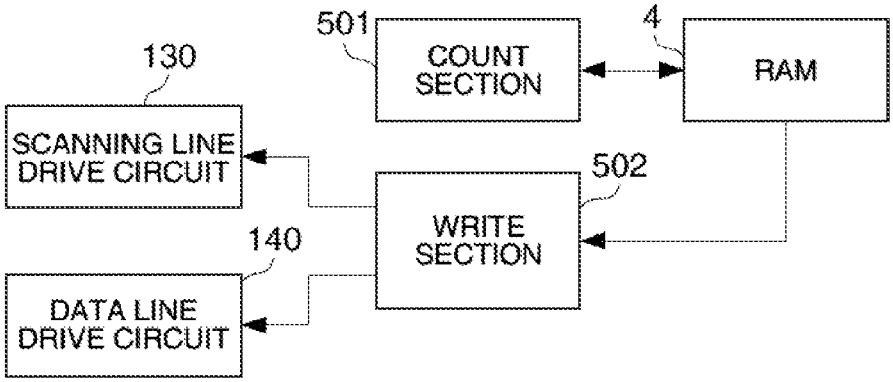
FIG. 12 is a block diagram of a functional configuration that is realized by a controller 5 in accordance with the second embodiment.

FIG. 12 is a block diagram showing functions achieved in the controller 5 of the present embodiment. The controller 5 realizes a count section 501 in addition to the write section 502. The count section 501 is a block that counts, in a writing operation to change the gray level of a pixel, the number of frames for each pixel that have been passed after the writing operation to change the gray level of the pixel to white or black begins. Each time one frame period passes, the count section 501 decrements the value of the counter memory area B(i, j).

Also, when a writing operation to change the gray level of a pixel to one of the gray levels, white or black, is to be stopped before the completion of the writing operation, and a writing operation to change the gray level to the other gray level is to be executed, the write section 502 in accordance with the present embodiment judges whether to stop the writing operation being executed based on the value of the counter memory area B(i, j). More specifically, when a writing operation to change the gray level of a pixel to one of the gray levels, white or black, is stopped before the completion of the writing operation, and a writing operation to change the gray level to the other gray level is executed, the writing operation being executed is stopped and the next writing operation is started if the value of the counter memory area B(i, j) is 0, meanwhile the writing operation being executed is continued without being stopped, if the value of the counter memory area B(i, j) is not 0.

Figure 13:
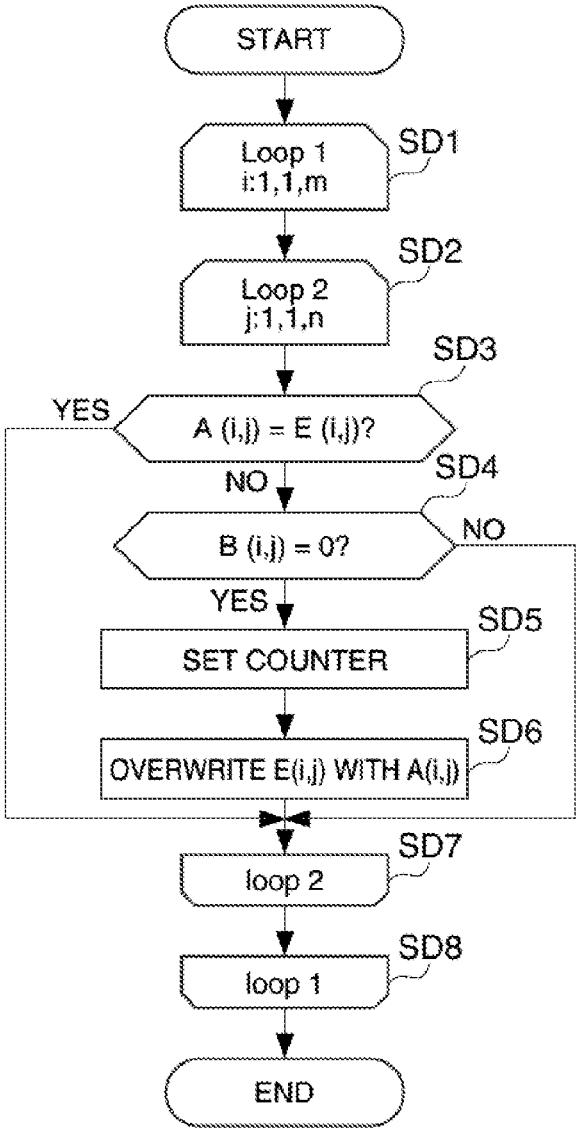
FIG. 13 is a flow chart showing process flow performed by the controller 5 in accordance with the second embodiment.
Figure 14:
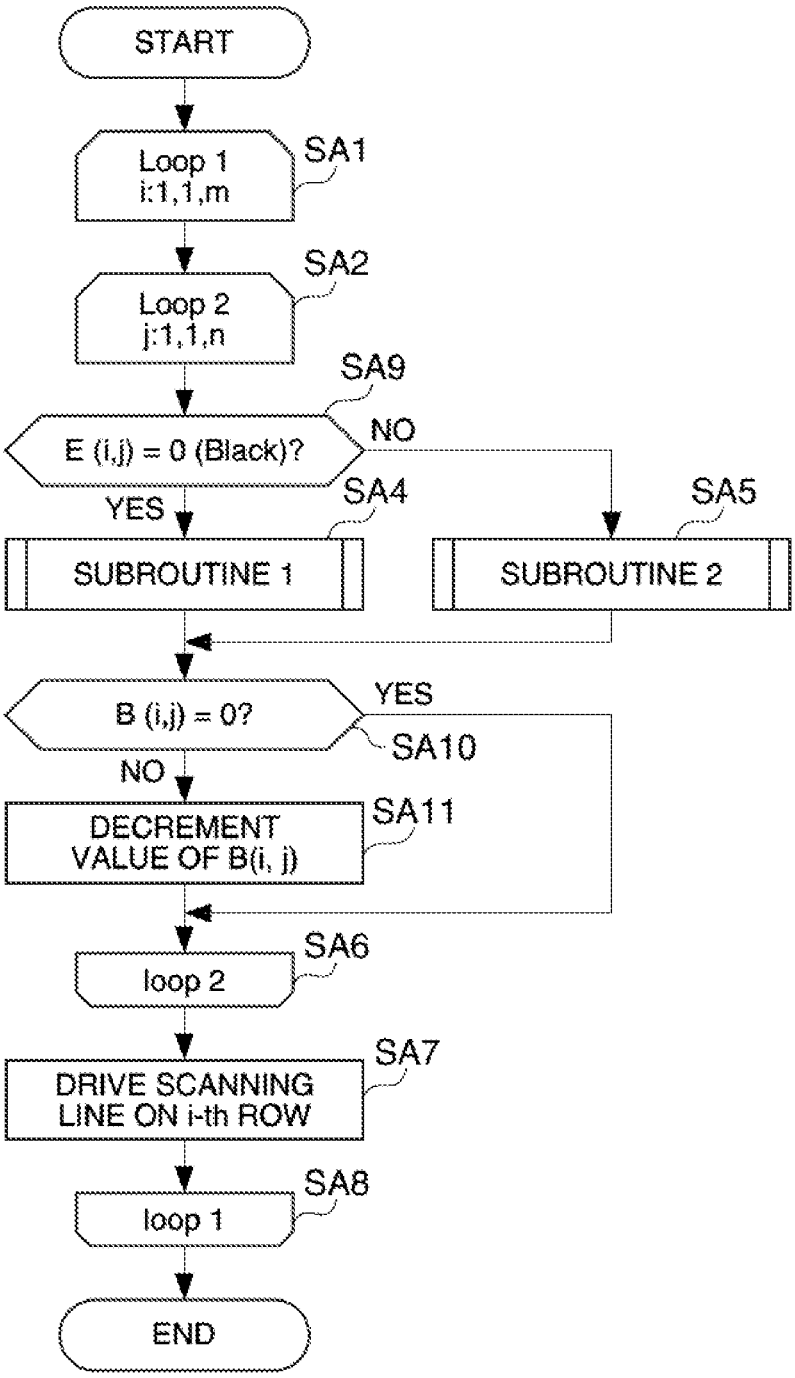
FIG. 14 is a flow chart showing process flow performed by the controller 5 in accordance with the second embodiment.
Figure 15:
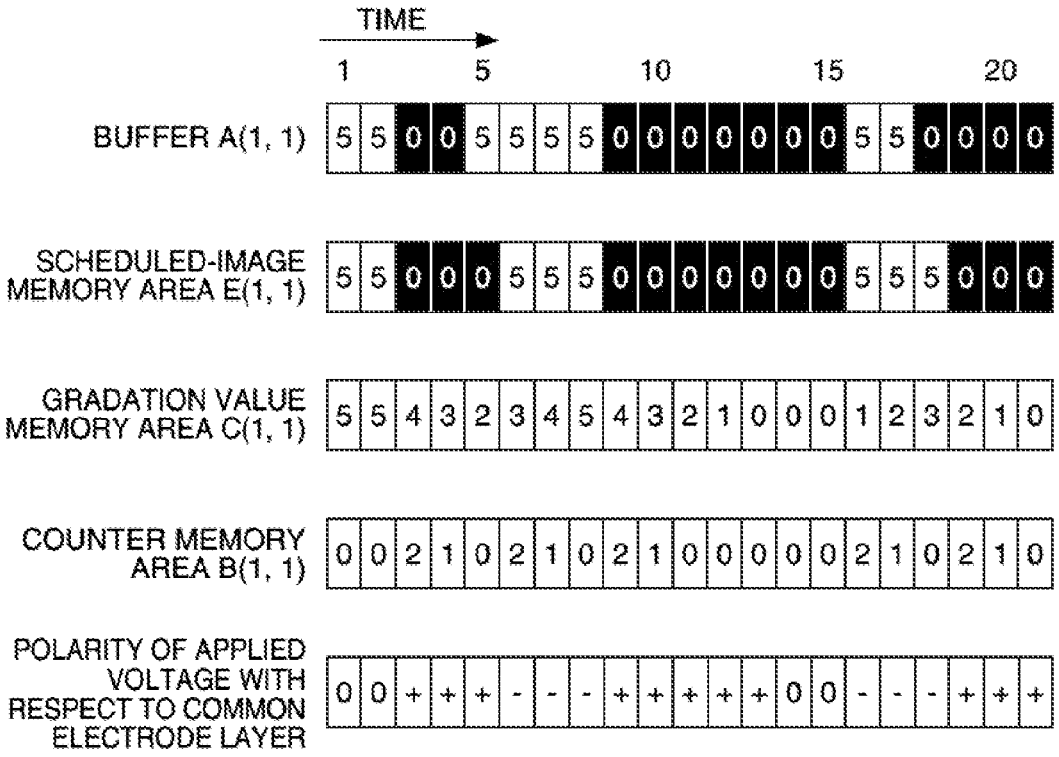
FIG. 15 is an illustration for explaining operations of the second embodiment.

Next, a process flow of the present embodiment will be described. FIG. 13 and FIG. 14 are flow charts showing the processing flow executed by the controller 5. FIG. 15 is an illustration showing the content of each memory area that changes with the passage of time, and shows the contents of the buffer A(1, 1), the gray level value memory area C(1, 1), the counter memory area B(1, 1), and the scheduled-image memory area E(1, 1) corresponding to one pixel P(1, 1). Moreover, FIG. 15 also shows the polarity of the voltage with respect to the common electrode layer 103*b* applied to the pixel electrode 101*d* during one frame period. The content of each memory area indicates a value after each frame period ends.

FIG. 13 is a chart showing the processing flow that is executed by the controller 5 before a frame period. The controller 5 rewrites the contents of the counter memory area B and the scheduled-image memory area E according to the contents of the buffer and each memory area.

First, the controller 5 initializes the variable i and the variable j to 1 (steps SD1 and SD2). Next, the controller 5 judges as to whether the value of the buffer A(i, j) is the same as the value of the scheduled-image memory area E(i, j). Here, when the value of the buffer A(i, j) is the same as the value of the scheduled-image memory area E(i, j) (YES in step SD3), the controller 5 moves the processing flow to step SD7.

On the other hand, when the value of scheduled-image memory area E(i,j) is different from the value of the buffer A(i,j) (NO in step SD3), the controller 5 judges if the value of the counter memory area B(i, j) is 0. When the value of the counter memory area B(i, j) is 0 (YES in step SD4), the controller 5 stores the number of frames (3 in the present embodiment) until the scheduled-image memory area E(i, j) becomes rewritable in the counter memory area B(i, j) (step SD5). When the step SD5 ends, the controller 5 overwrites the value of the scheduled-image memory area E(i, j) with the value of the buffer A(i, j) (step SD6). When the value of the counter memory area B(i, j) is not 0 (NO in step SD4), the controller 5 moves the processing flow to step SD7.

The controller 5 judges in step SD7 as to whether the value of the variable j is n. The controller 5 increments the variable j when the value of the variable j is not n, and moves the processing flow to step SA3. Moreover, when the value of the variable j is n, the controller 5 judges in step SD 8 as to whether the value of the variable i is m. When the value of the variable i is not m, the controller 5 increments the variable I, and moves the processing flow to step SD2. Also, when the value of the variable i is m, the controller 5 ends the processing of FIG. 12.

FIG. 14 is a flow chart showing the flow of the processing executed by the controller 5 during a frame period in accordance with the second embodiment. The controller 5 judges if the value of the scheduled-image memory area E(i, j) is 0 (black) after step SA2, in contrast to the processing of FIG. 6 in accordance with the first embodiment. When the value of the scheduled-image memory area E(i, j) is 0 (YES in step SA 9), the controller 5 processes step SA4, and when the value of the scheduled-image memory area E(i,j) is 5 (white) (NO in step SA9), the controller 5 processes step SA5.

Next, the controller 5 judges if the value of the counter memory area B(i, j) is 0. When the value of the counter memory area B(i, j) is not 0 (NO in step SA10), the controller 5 decrements the value of the counter memory area B(i, j) (step SA11). When the value of the counter memory area B(i, j) is 0 (YES in step SA10), the controller 5 moves the flow of processing to step SA6.

Operation Example of Second Embodiment

Next, operations to be executed when the content of the buffer A (1, 1) changes will be described with reference to FIG. 15. When the pixel data of the buffer A(1, 1) is rewritten from 5 to 0 by the control section 2 before the third frame begun, as shown in FIG. 15, because the value (0) of the buffer A(1, 1) at this point is different from the value (5) of the scheduled-image memory area E(1, 1) (NO in step SD3), the controller 5 judges if the value of the counter memory area B(1, 1) is 0. Here, when the value of the counter memory area B(1, 1) is 0 (YES in step SD4) before the third frame starts as shown in FIG. 15, the controller 5 stores, in the counter storage area B(1, 1), the number of frames (3 in the present embodiment) until the scheduled-image memory area E(1, 1) becomes rewritable (step SD5), and overwrites the content of the scheduled-image memory area E(1, 1) with the content of the buffer A(1,1) to 0 (step SD6).

Next, when the frame period starts, because the value of the scheduled-image memory area E(1, 1) is 0 at the time of the beginning of the third frame, the controller 5 judges YES in step SA9, and performs the processing in step SA4 (the processing of FIG. 7). Because the content of the counter memory area B(1, 1) is 3 here after the processing in step SA4 ends, the controller 5 judges NO in step SA10 and decrements the value of the counter memory area B(1, 1). Then, when the scanning line 112 on the $1^{st}$ row is driven (step SA7), the voltage of +15V with respect to voltage Vcom is applied to the pixel electrode 101*d* of the pixel at the $1^{st}$ row and $1^{st}$ column, such that black electrophoretic particles moves to the side of the common electrode layer 103*b*.

When the content of the VRAM 3 is rewritten before the $5^{th}$ frame starts, and the pixel data of the buffer A(1, 1) is rewritten to 5, the controller 5 judges NO in step SD3. Next, because the content of the counter memory area B(1, 1) is 1 here, the controller 5 judges NO in step SD4, and moves the flow of processing to step SD7. In other words, though the content of the buffer A(1, 1) and the content of the scheduled-image memory area E(1,1) are different from each other, it is judged that the number of frames that has passed after the start of the writing operation is two or less, such that the content of the scheduled-image memory area E(1,1) would not be overwritten by the content of the buffer A(1, 1). Then, when a frame period starts, the controller 5 judge YES in step SA9 because the content of the scheduled-image memory area E(1, 1) is 0, and processes step SA4. Next, the controller 5 judges NO in step SA10 because the content of the counter memory area B(1, 1) is 1 here, and therefore decrements the value of the counter memory area B(1, 1) to 0 (step SA11). Then, as the scanning line 112 on the $1^{st}$ row is driven (step SA7), the voltage of +15V with respect to voltage Vcom is applied to the pixel electrode 101*d* of the pixel at the $1^{st}$ row and the $1^{st}$ column, such that black electrophoretic particles move to the side of the common electrode layer 103*b*.

Then, after the fifth frame ends, the operation of the controller 5 is executed as follows. First, before the beginning the sixth frame, because the value of the buffer A(1, 1) is 5 at this point, and the value of the scheduled-image memory area E(1, 1) is 0, the controller 5 judges NO in step SD3. Next, the controller 5 judges YES in step SD4 because the content of the counter memory area B(1, 1) is 0 here, stores, in the counter memory area C(1, 1), the number of frames (3 in the present embodiment) until the scheduled-image memory area E(1, 1) becomes rewritable (step SD5), and overwrites the content of the scheduled-image memory area E(1, 1) with the content of the buffer A(1, 1) to 5 (step SD6). In other words, the writing operation to change the gray level of the pixel P(1, 1) to 5 (white) is started, because it was judged that the number of frames that has passed after the writing operation started was 3 or more in step SD4.

Then, when the frame period starts, the controller 5 judges NO in step SA9, and processes step SA5 (the processing of FIG. 8). Next, the controller 5 judges NO in step SA10 because the content of the counter memory area B(1, 1) is 3 here, and decrements the value of the counter memory area B(1, 1). Then, when the scanning line 112 on the $1^{st}$ row is driven (step SA7), the voltage of −15V with respect to the voltage Vcom is applied to the pixel electrode 101*d* of the pixel at the $1^{st}$ row and the $1^{st}$ column, such that white electrophoretic particles move to the side of the common electrode layer 103*b*.

Therefore, in the present embodiment, when the gray level of a pixel, while it is being changed from white to black, is changed to white, the application of the voltage for changing the gray level of the pixel to white will be started after the voltage for changing the gray level of the pixel to black is applied a predetermined number of times.

Thereafter, the voltage of −15V with respect to voltage Vcom is applied to the pixel electrode 101*d* of the pixel P(1, 1) up to the $8^{th}$ frame, such that white electrophoretic particles move to the side of the common electrode layer 103*b*. It can be seen that, from the $3^{rd}$ frame to the $8^{th}$ frame, the voltage for changing the pixel to black is applied three times, and then the voltage for changing the pixel to white is applied three times. In other words, when the gray level of the pixel, while being changed from white to black, is changed to white, the voltage to change the pixel to white is applied the same number of times as the number of times the voltage has been applied for changing the pixel to black. Therefore, deviation would not be generated between the number of times of voltage application for changing the pixel to black and the number of times of voltage application for changing the pixel to white.

Next, when the pixel data of the buffer A(1, 1) is rewritten from 5 in 0 before the $9^{th}$ frame starts, the processing similar to that for the $3^{rd}$ frame is performed. Thereafter, if the pixel data of the buffer A(1, 1) is not changed until the value of the gray level value memory area C(1, 1) becomes 0, the voltage of +15V with respect to the voltage Vcom is applied to the pixel electrode 101*d* of the pixel at the $1^{st}$ row and the $1^{st}$ column, such that black electrophoretic particles move to the side of the common electrode layer 103*b*.

Next, when the pixel data of the buffer A(1, 1) is rewritten from 0 in 5 by the control section 2 before the $16^{th}$ frame starts, because the value (5) of the buffer A(1, 1) is different from the value (0) of the scheduled-image memory area E(1, 1) (NO in step SD3) at this point, the controller 5 judges if the value of the counter memory area B(1, 1) is 0. Here, when the value of the counter memory area B(1, 1) is 0(YES in step SD4) before the $16^{th}$ frame starts, as shown in FIG. 15, the controller 5 stores, in the counter memory area B(1, 1), the number of frames (3 in the present embodiment) until the scheduled-image memory area E(1, 1) becomes rewritable (step SD5), and overwrites the content of the scheduled-image memory area E(1, 1) with the content of the buffer A(1, 1) to 5 (step SD6).

Then, when a frame period starts, the controller 5 judges NO in step SA9 because the value of the scheduled-image memory area E(1, 1) is 5 at the time of starting the $16^{th}$ frame, and processes step SA5. Next, the controller 5 judges NO in step SA10 because the content of the counter memory area B(1, 1) is 3 here, and therefore decrements the value of the counter memory area B(1, 1). Then, as the scanning line 112 on the $1^{st}$ row is driven (step SA7), the voltage of −15V with respect to voltage Vcom is applied to the pixel electrode 101*d* of the pixel at the $1^{st}$ row and the $1^{st}$ column, such that white electrophoretic particles move to the side of the common electrode layer 103*b*.

Then, when the content of the VRAM 3 is rewritten before the $18^{th}$ frame starts, and the pixel data of the buffer A(1, 1) is changed to 0, the controller 5 judges NO in step SD3. Next, because the content of the counter memory area B(1, 1) is 1 here, the controller 5 judges NO in step SD4, and moves the flow of processing to step SD7. In other words, though the content of the buffer A(1, 1) and the content of the scheduled-image memory area E(1,1) are different from each other, it is judged that the number of frames that has passed after the writing operation started is two or less, such that the content of the scheduled-image memory area E(1, 1) would not be overwritten by the content of the buffer A(1, 1). Then, when a frame period starts, the controller 5 judge NO in step SA9 because the content of the scheduled-image memory area E(1, 1) is 5, and processes step SA5. Next, the controller 5 judges NO in step SA10 because the content of the counter memory area B(1, 1) is 1 here, and therefore decrements the value of the counter memory area B(1, 1) to 0(step SA11). Then, as the scanning line 112 on the $1^{st}$ row is driven (step SA7), the voltage of −15V with respect to voltage Vcom is applied to the pixel electrode 101*d* of the pixel at the $1^{st}$ row and the $1^{st}$ column, such that white electrophoretic particles move to the side of the common electrode layer 103*b*.

Then, after the $18^{th}$ frame ends, because the value of the buffer A(1, 1) is 0 at this point, and the value of the scheduled-image memory area E(1, 1) is 5, the controller 5 judges NO in step SD3. Next, the controller 5 judges YES in step SD4 because the content of the counter memory area B(1, 1) is 0 here, stores, in the counter memory area C(1, 1), the number of frames (3 in the present embodiment) until the scheduled-image memory area E(1, 1) becomes rewritable (step SD5), and overwrites the content of the scheduled-image memory area E(1, 1) with the content of the buffer A(1, 1) to 0 (step SD6). In other words, the writing operation to change the gray level of the pixel P(1, 1) to 0 (black) is started, because it was judged that the number of frames that has passed after the writing operation started was 3 or more in step SD4.

Then, when a frame period starts, the controller 5 judges YES in step SA9, and processes step SA4. Next, the controller 5 judges NO in step SA10 because the content of the counter memory area B(1, 1) is 3 here, and decrements the value of the counter memory area B(1, 1). Then, when the scanning line 112 on the $1^{st}$ row is driven (step SA7), the voltage of +15V with respect to the voltage Vcom is applied to the pixel electrode 101*d* of the pixel at the $1^{st}$ row and the $1^{st}$ column, such that black electrophoretic particles move to the side of the common electrode layer 103*b*.

Therefore, in the present embodiment, when the gray level of a pixel, while it is being changed from black to white, is changed to black, the application of the voltage for changing the gray level of the pixel to black will be started after the voltage for changing the gray level of the pixel to white is applied a predetermined number of times.

Thereafter, the voltage of +15V with respect to voltage Vcom is applied to the pixel electrode 101*d* of the pixel P(1, 1) up to the $21^{st}$ frame, such that black electrophoretic particles move to the side of the common electrode layer 103*b*. It can be seen that, from the $16^{th}$ frame to the $21^{st}$ frame, the voltage for changing the pixel to white is applied three times, and then the voltage for changing the pixel to black is applied three times. In other words, when the gray level of the pixel, while being changed from black to white, is changed to black, the voltage to change the pixel to black is applied the same number of times as the number of times the voltage has been applied for changing the pixel to white. Therefore, deviation would not be generated between the number of times of voltage application for changing the pixel to black and the number of times of voltage application for changing the pixel to white.

Electronic Apparatus

Figure 16:
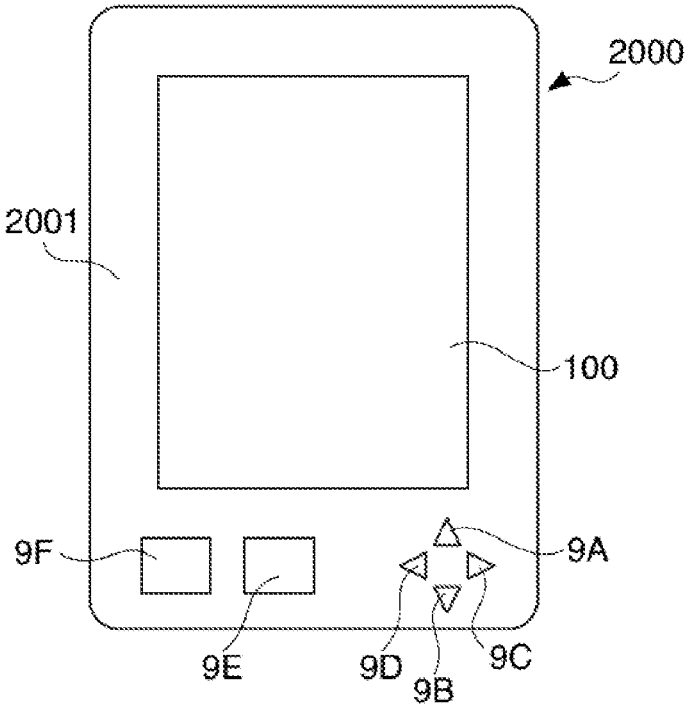
FIG. 16 is an external view of an electronic book reader 2000.

Next, an example of an electronic apparatus to which the display device 1000 according to the embodiment is applied will be described. FIG. 16 is a view showing the appearance of an electronic book reader using the display device 1000 in accordance with the embodiment described above. An electronic book reader 2000 includes a plate shaped frame 2001, buttons 9A to 9F, the electro-optical device 1 according to the embodiment described above, the control unit 2, the VRAM 3, and the RAM 4. In the electronic book reader 2000, the display area 100 is exposed. In the electronic book reader 2000, the content of electronic book is displayed in the display area 100, and the pages of the electronic book are turned over by operating the buttons 9A to 9F. In addition, examples of an electronic apparatus to which the electro-optical device 1 according to the embodiment described above can be applied may include a timepiece, electronic paper, an electronic diary, a calculator, a mobile phone, and the like.

While the embodiments of the invention have been described above, the invention is not limited to the embodiments described above and various modifications may also be made. For example, the invention may also be implemented by modifying the above-described embodiments as follows. In addition, the above-described embodiments and the following modification examples may be combined.

In the embodiment described above, the electro-optical device including the electrophoretic layer 102 has been described as an example. However, the invention is not at all limited to such example. The invention is applicable to any electro-optical device as long as the writing for changing the display state of a pixel from the first display state to the second display state is performed by a writing operation in which voltage is applied multiple times. For example, it is also possible to use an electro-optical device using electronic liquid powder.

In the embodiments described above, the number of times of voltage application for changing the pixel from white to black, and the number of times of voltage application for changing the pixel from black to white are five times. However, the number of times of voltage application is not limited to this specific number, but may be less than 5, or 6 or greater.

The entire disclosure of Japanese Patent Application No. 2012-045581, filed Mar. 1, 2012 is expressly incorporated by reference herein.

What is claimed is:

1. A control device for controlling an electro-optical device that includes a display section including a plurality of pixels, the electro-optical device performing a first write operation to change a pixel from a first gray level to a second gray level and a second write operation to change the pixel from the second gray level to the first gray level through applying voltage to the pixel multiple times, the polarity of the voltage for changing the pixel to the first gray level and the polarity of the voltage for changing the pixel to the second gray level being different from each other, the control device comprising:

a write section that, when stopping a first write operation to change the pixel into one of the first gray level and the second gray level before completion of the write operation, and executing a second write operation to change the pixel into another of the first gray level and the second gray level, executes the second write operation by voltage application to change the pixel into the other gray level, wherein:

during the first write operation, a first polarity voltage is applied during a first number of frames, and during the second write operation after the first write operation has been stopped, a second polarity voltage is applied during a second number of frames that is the same as the first number of frames during which the first polarity voltage is applied during the first write operation.

2. A control device according to claim 1, comprising a counter section that counts the number of frames for each pixel that has passed since the first write operation to change the pixel to the first gray level or the second gray level started, when stopping a first write operation to change the pixel into the one of the gray levels before completion of the write operation, and executing a second write operation to change the pixel into the other of the gray levels, the write section stops the second write operation to change the pixel into the one gray level after the number of frames counted by the counter section reaches a predetermined number of frames.

3. A control method for controlling an electro-optic device that includes a display section including a plurality of pixels, the control method including performing a first write operation to change a pixel from a first gray level to a second gray level and a second write operation to change the pixel from the second gray level to the first gray level through applying voltage to the pixel multiple times, the polarity of the voltage for changing the pixel to the first gray level and the polarity of the voltage for changing the pixel to the second gray level being different from each other, the control method comprising:

when stopping a first write operation to change the pixel into one of the first gray level and the second gray level before completion of the write operation, and executing a second write operation to change the pixel into the other gray level, executing the second write operation to change the pixel into the other gray level, wherein:

during the first write operation, a first polarity voltage is applied during a first number of frames, and during the second write operation after the first write operation has been stopped, a second polarity voltage is applied during a second number of frames that is the same as the first number of frames during which the first polarity voltage is applied during the first write operation.

4. An electro-optic device having a display section including a plurality of pixels, the electro-optic device performing a first write operation to change a pixel from a first gray level to a second gray level and a second write operation to change the pixel from the second gray level to the first gray level through applying voltage to the pixel multiple times, the polarity of the voltage for changing the pixel to the first gray level and the polarity of the voltage for changing the pixel to the second gray level being different from each other, the electro-optic device comprising:

a write section that, when stopping a first write operation to change the pixel into one of the first gray level and the second gray level before completion of the write operation, and executing a second write operation to change the pixel into the other gray level, executes the second write operation to change the pixel into the other gray level, wherein:

during the first write operation, a first polarity voltage is applied during a first number of frames, and during the second write operation after the first write operation has been stopped, a second polarity voltage is applied during a second number of frames that is the same as the first number of frames during which the first polarity voltage is applied during the first write operation.

5. An electronic apparatus comprising the electro-optic device recited in claim 4.

* * * * *